US006823610B1

(12) United States Patent
Ashley

(10) Patent No.: US 6,823,610 B1
(45) Date of Patent: Nov. 30, 2004

(54) SHOE LACE FASTENER

(76) Inventor: John P. Ashley, 6809 Pine Dr., Chattanooga, TN (US) 37421

( * ) Notice: Subject to any disclaimer, the term of this patent is extended or adjusted under 35 U.S.C. 154(b) by 67 days.

(21) Appl. No.: 10/313,622

(22) Filed: Dec. 6, 2002

(51) Int. Cl.[7] ..... A43B 23/26; A43C 11/20
(52) U.S. Cl. ..... 36/54; 36/51
(58) Field of Search ..... 36/54, 51; 24/712.2, 24/712.4, 713.2, 712.1

(56) References Cited

U.S. PATENT DOCUMENTS

| | | | | | |
|---|---|---|---|---|---|
| 662,519 | A | | 11/1900 | Beach | |
| 743,954 | A | | 11/1903 | Thoma | |
| 756,940 | A | | 4/1904 | Conger | |
| 886,792 | A | * | 5/1908 | Gayton | 24/712.7 |
| 1,028,598 | A | * | 6/1912 | Papp | 36/54 |
| 1,146,934 | A | | 7/1915 | Gleeson | |
| 1,531,410 | A | | 3/1925 | Osterholt | |
| 1,624,564 | A | | 4/1927 | Shetzline | |
| 1,879,475 | A | | 9/1932 | Poon | |
| 2,305,552 | A | | 12/1942 | Nyhagen | |
| 2,650,399 | A | | 9/1953 | Torelli | |
| 3,066,370 | A | | 12/1962 | Epstein | |
| 3,500,508 | A | | 3/1970 | Bennett | |
| 4,290,172 | A | | 9/1981 | Burton | 24/117 |
| 4,291,439 | A | | 9/1981 | Riti | 24/117 |
| 4,545,138 | A | * | 10/1985 | Blum | 36/51 |
| 4,553,293 | A | | 11/1985 | Blum | 24/117 |
| 4,780,936 | A | | 11/1988 | Brecher | 24/119 |
| 4,879,787 | A | | 11/1989 | Walls | 24/712.2 |
| 4,949,437 | A | * | 8/1990 | Anderson | 24/712.2 |
| 5,467,511 | A | | 11/1995 | Kubo | 24/712.9 |
| 5,903,959 | A | | 5/1999 | Leonardi | 24/712.1 |
| 5,913,483 | A | | 6/1999 | Polk | 24/712.3 |
| 5,924,177 | A | | 7/1999 | Jongejan | 24/712.2 |
| 5,979,028 | A | | 11/1999 | Hicks et al. | 24/712.9 |
| 6,026,548 | A | | 2/2000 | Jackson | 24/712 |
| 6,038,792 | A | | 3/2000 | Hauter | 36/133 |
| 6,178,606 | B1 | | 1/2001 | Glendon | 24/712.5 |
| 6,240,607 | B1 | | 6/2001 | McCrary | 24/712.1 |
| 6,247,214 | B1 | | 6/2001 | Hyde | 24/712.6 |
| 6,338,186 | B1 | * | 1/2002 | Kleinmann | 24/712.2 |
| 6,473,999 | B2 | * | 11/2002 | Fellouhe | 36/50.1 |

* cited by examiner

*Primary Examiner*—Ted Kavanaugh
(74) *Attorney, Agent, or Firm*—Miller & Martin PLLC

(57) ABSTRACT

A device for securing and restraining the loops and tails of tied shoe laces prevents the laces from becoming loosened and untied. A tab is mounted on a tension band to permit the loops and tails to be passed between the tension band and the shoe tongue and the loops end tails held securing next to the tongue and facings of the shoe.

20 Claims, 13 Drawing Sheets

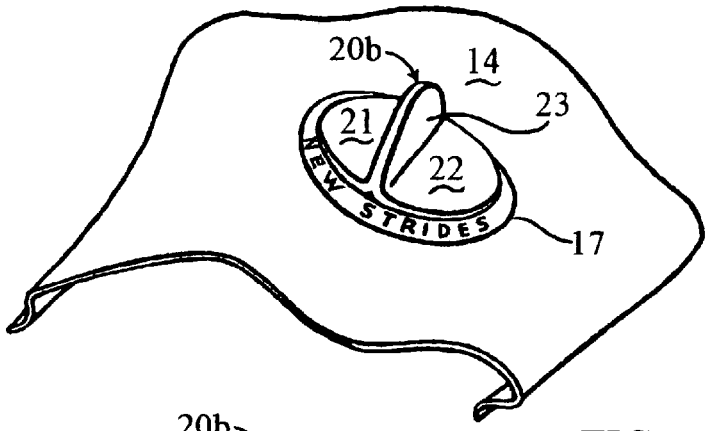
FIGURE 7A
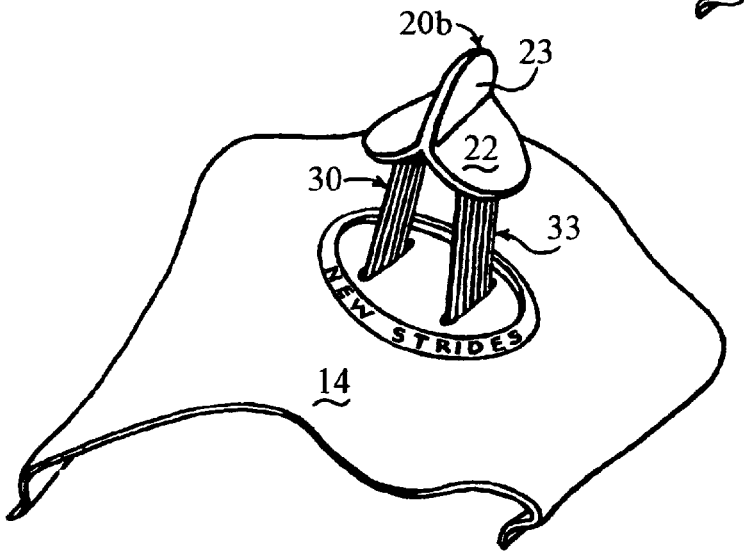
FIGURE 7B
FIGURE 8
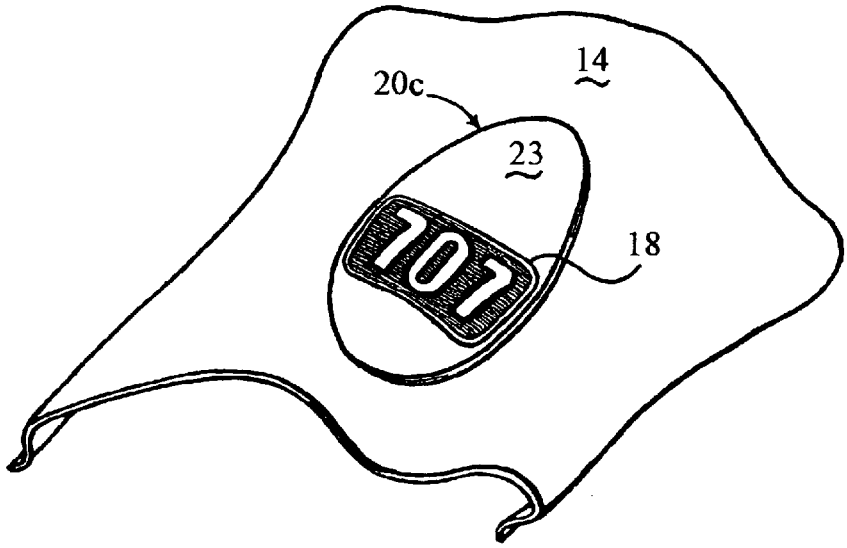

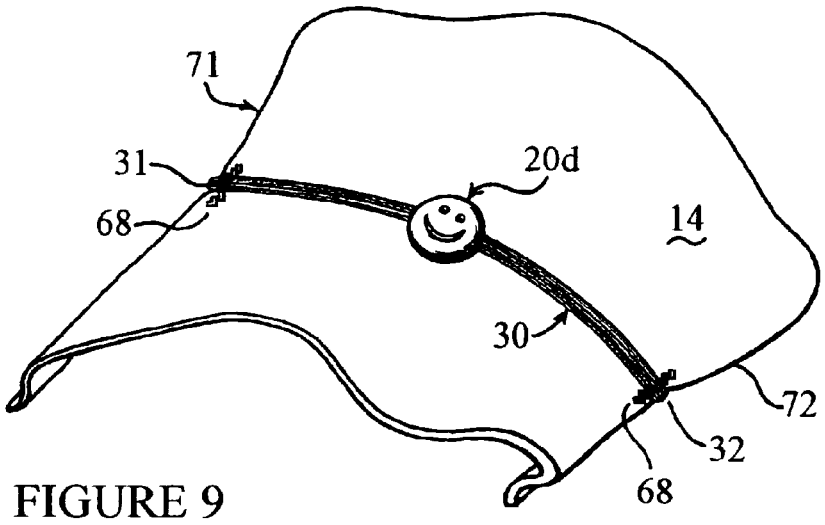
FIGURE 9
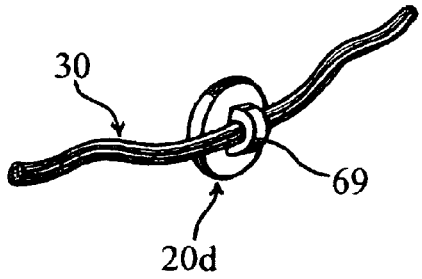
FIGURE 10
FIGURE 11
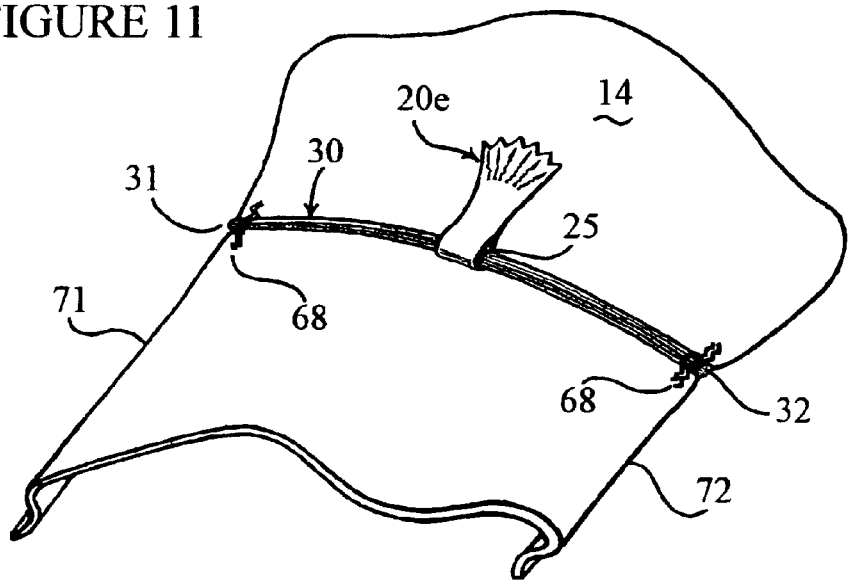

SHOE LACE FASTENER

FIELD OF THE INVENTION

The present invention relates to devices for securing shoe laces. In particular, the invention discloses a family of fastening devices which may be utilized to secure either or both of the loops and tails of a shoe lace bow knot proximate to the shoe.

BACKGROUND OF THE INVENTION

Many devices have been proposed for securing shoe laces in the prior art. The extensive nature of the prior art suggests that problems with laced shoes coming untied and the tails of laces hanging loosely have existed for many decades. While flat profile cotton laces are often still used in children's footwear, materials such as polyester, nylon and other synthetics are now more frequently used in laces. These fibers have inherently less friction than cotton fibers, permitting knots to loosen more easily. In addition, the round woven profile style of laces is in widespread use and this style is more difficult to keep tied than flat profile laces. The tendency of round laces to come untied in all shoes, and especially in athletic shoes, appears established. Makers of athletic shoes also frequently provide those shoes with extra length laces which leads to loops and tails of substantial length after the shoes are knotted. Management of these long loops and tails presents a distraction for the athlete. Untied laces also present hazards not only for athletes, but also wearers of laced footwear of any age, and pose special hazards for infants and the infirm. Many athletes in some sports, such as soccer, have resorted to wrapping their shoes and laces with tape to hold the laces in place.

The prior art is replete with impractical, bulky, complicated and expensive aftermarket devices. These various apparatus have typically involved cumbersome implementation, as perhaps by weaving laces through or around the device or by utilizing some nature of resilient clip. The inherent defect with virtually all prior art devices is that those devices are more trouble to install and additionally more trouble for the wearer to utilize upon each wearing of the shoe, than it would be simply to stop and retie the shoe.

BRIEF SUMMARY OF THE INVENTION

In view of the disadvantages inherent in prior art devices for securing shoe laces, the present invention provides a new construction using a tension strap and tab for securing shoe lace loops and tails proximate to the shoe.

It is the purpose of the present invention to provide a shoe lace fastener which can be integrally formed in a shoe tongue when the shoe is being constructed without significant additional expense or labor.

It is yet another object of the invention to provide a shoe lace fastener that may be used when needed, or left unused at the wearer's option without detraction from the aesthetic appearance of the shoe.

It is a further object of the invention to provide a shoe lace fastener that can be easily secured as an aftermarket add-on by consumers particularly concerned with shoe lace retention.

To obtain these goals the present invention provides a tab on a tension band extending across a portion of a shoe tongue. The tension band is preferably secured by a foundation plate in the tongue having two guide slots through which a central portion of the band extends and forms a central tab engaging section. Ends of the tension band are secured to either or both of the tongue and the foundation plate. A tab is mounted on the central tab engaging section of the band. When the tab is pulled, the tension band stretches and defines an opening above the shoe tongue through which either or both of the loops and tails of a knotted shoe lace may be passed. The tab is then released and the tension band securely holds the loops and tails proximate to the shoe.

According to the objects of the invention the shoe lace fastener devices of the present invention may be manufactured in a variety of designs in order to be compatible with many different shoe styles. The foregoing and other objects of the invention are more fully explained in connection with the accompanying drawings and description of several preferred embodiments of the invention.

BRIEF DESCRIPTION OF THE DRAWINGS

FIGS. 7A and 7B illustrate an alternative embodiment of the shoe lace fastener in which the fastener is received within a housing on the surface of the shoe tongue.

FIG. 8 illustrates an alternative embodiment of the shoe lace fastener of the present invention in which the tab member has a decorative or logo section and the grasping portion of the tab lies in relatively flat position.

FIG. 9 is a view of another alternative embodiment of a shoe lace fastener according to the invention installed on a shoe tongue.

FIG. 10 is a view of the tension band and tab components of the shoe lace fastener of FIG. 9.

FIG. 11 is yet another alternative embodiment of a shoe lace fastener according to the invention.

DETAILED DESCRIPTION OF THE INVENTION

The present shoe lace fastener devices are intended for use on laced shoes of conventional design. While the fasteners may be used on any laced shoes, it is believed that they will prove most useful on children's shoes and athletic shoes. A customary laced shoe comprises a sole and an upper. The upper extends from the front or toe of the shoe rearward to the vamp, generally considered the section above the ball of the foot where the shoe flexes then to the waist, the quarter, and finally to the collar and heel counter which wrap around the back of the wearer's foot. On a laced shoe the waist portion, generally extending between the wearer's instep to the ball of the foot, rises upward and over the foot ending in a facing. Eyelets for lacing the shoe are placed in the facing. On the top of the shoe the vamp extends rearward into a throat beneath the facings and then into a tongue which extends underneath the laced areas to protect the top of the wearer's foot.

Figure 1:
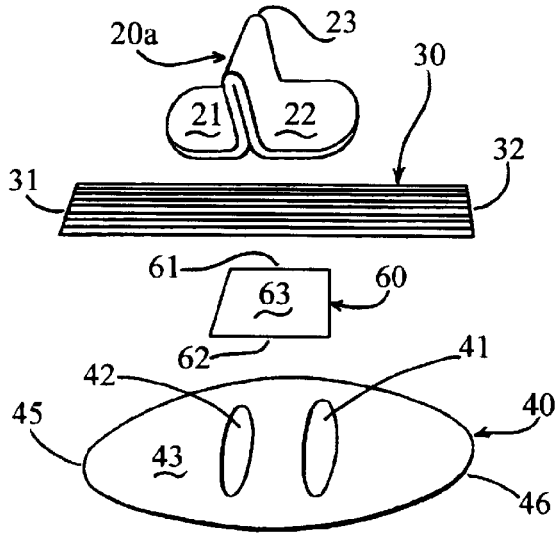
FIG. 1 is an exploded perspective view of the elements of a preferred embodiment of the shoe lace fastener invention.

As shown in FIG. 1 a preferred design of shoe lace fastener according to the present invention consists of a tab such as winged pull tab 20*a,* a tension band, such as an elastic strap, 30, and a foundation plate 40 which may be mounted in the tongue of a shoe. Preferably, the foundation plate is mounted beneath at least a top layer 14 of the tongue (shown in FIG. 3A) and above a bottom layer of the tongue. Even more advantageously, the foundation plate may be above a padding layer within the tongue. Winged pull tab 20*a* is advantageously made of nylon belting material, but may alternatively be made of other fabrics or even cast or molded, most advantageously from thermoplastic resin. Winged pull tab 20*a* has a grasping section 23, a left wing 21 and right wing 22. The tension band 30 has a left end 31 and right end 32 and an intermediate stretching section 33, shown in extended form in FIG. 6D. In the embodiment of FIG. 1, a tab belly piece 60 is utilized to secure the tab 20*a* in slideable communication with the tension band 30. The top edge 61 of belly piece 60 and the bottom edge 62 are joined to the edges of winged pull tab 20*a* defining a passageway through which tension band 30 passes. The belly piece 60 may be made of nylon fabric or other suitable material. It will be appreciated that both the winged tab 20*a* and belly piece 60 are slightly wider than the tension strap 30. In a preferred embodiment, left end 31 of tension band 30 passes downward through left guide slot 42 of foundation plate 40 and is fastened at the left side 45 of plate 40. Similarly, right end 32 of tension band 30 is passed through right guide slot 41 and fastened at right side 46 of plate 40. The foundation plate is advantageously made of a pliant non-woven material or sheet plastic, that will conform to the shape of the wearer's foot, while still providing some lateral stiffness. The ends 31, 32 of tension band 30 may be joined to the foundation plate 40 by sewing, adhesives, or suitable heat or chemical fusion.

Figure 2A:
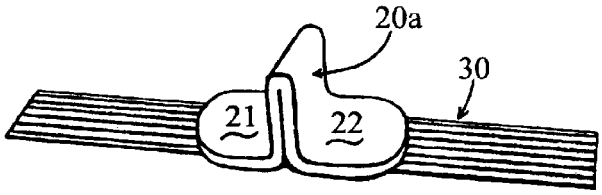
FIGS. 2A and 2B are top and bottom perspective views of assembled tab and tension band components of the shoe lace fastener of FIG. 1.
Figure 2B:
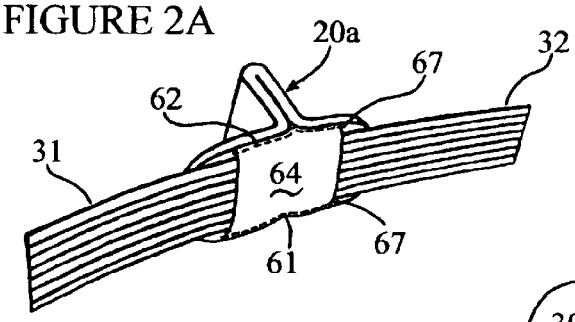

FIG. 2A shows in isolation winged pull tab 20*a* mounted on tension band 30. FIG. 2B shows a bottom view where stitching or sonic welding 67 has been utilized to attach a belly piece 60 along its top edge 61 and bottom edge 62 to the bottom of winged tab 20*a* securing tension band 30 between the bottom of winged tab 20*a* and the top surface 63 of belly piece 60. As will be clear from FIGS. 3A through 3C, when assembling the shoe lace fastener, the winged pull tab 20*a* is first assembled with belly piece 60 about tension band 30, while foundation plate 40 is positioned beneath at least top layer 14 of shoe tongue 13, and left opening 15 and right opening 16 in layer 14 are aligned with guide slots 42 and 41 of foundation plate 40. Left end 31 and right end 32 of tension band 30 are then inserted through openings 15, 16 and guide slots 42, 41 and tension band ends 31, 32 are stitched or otherwise bonded to left and right portions 45, 46 of foundation plate 40.

Figure 3A:
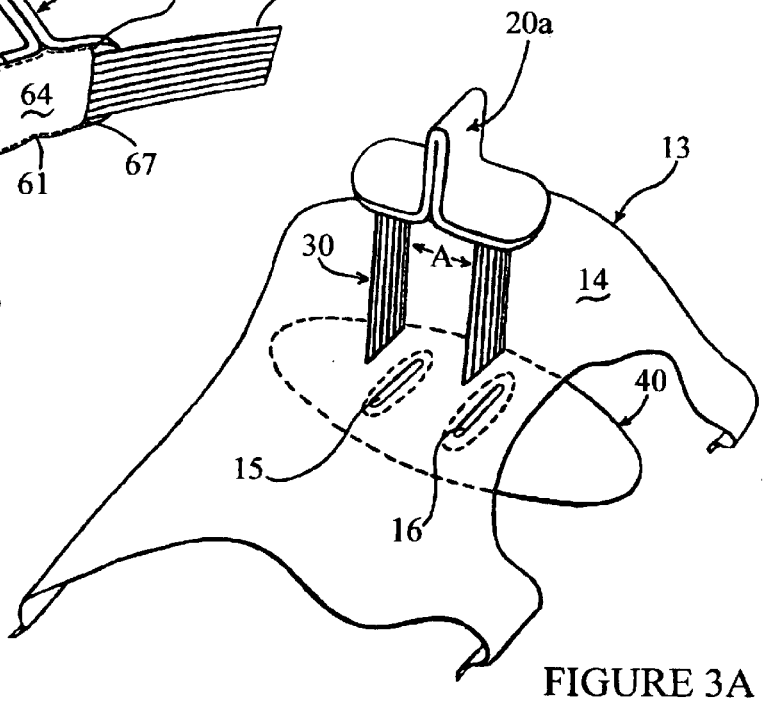
FIGS. 3A through 3C illustrate the sequential assembly of the shoe lace fastener of FIG. 1 on the tongue of a shoe.
Figure 3B:
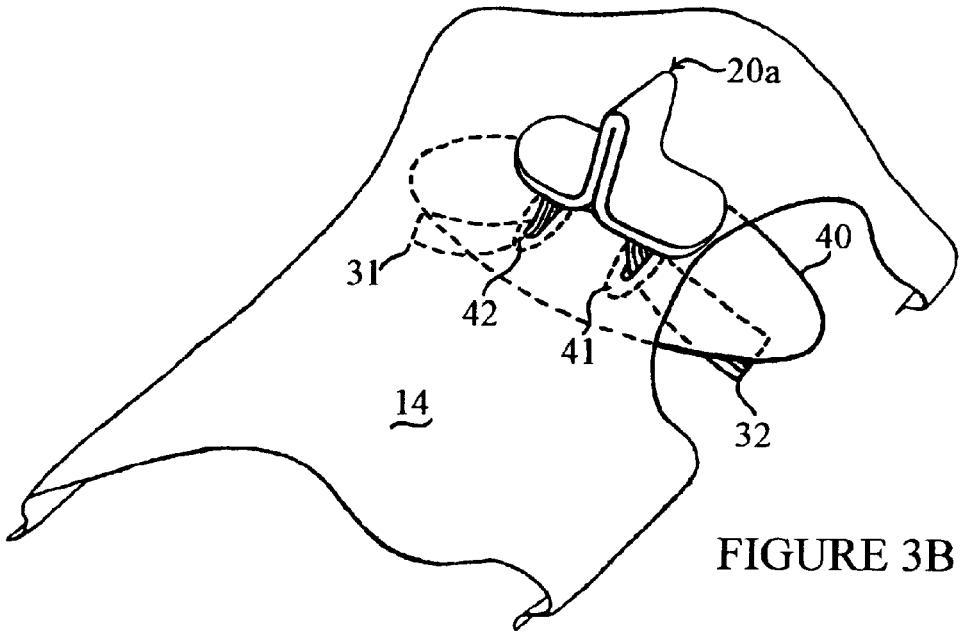
Figure 3C:
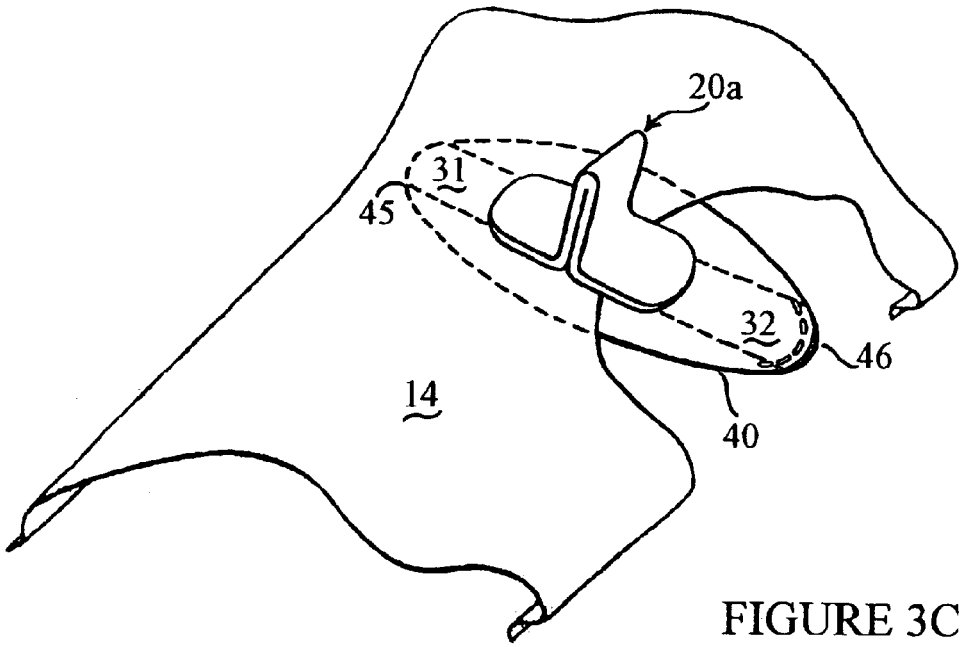
Figure 4:
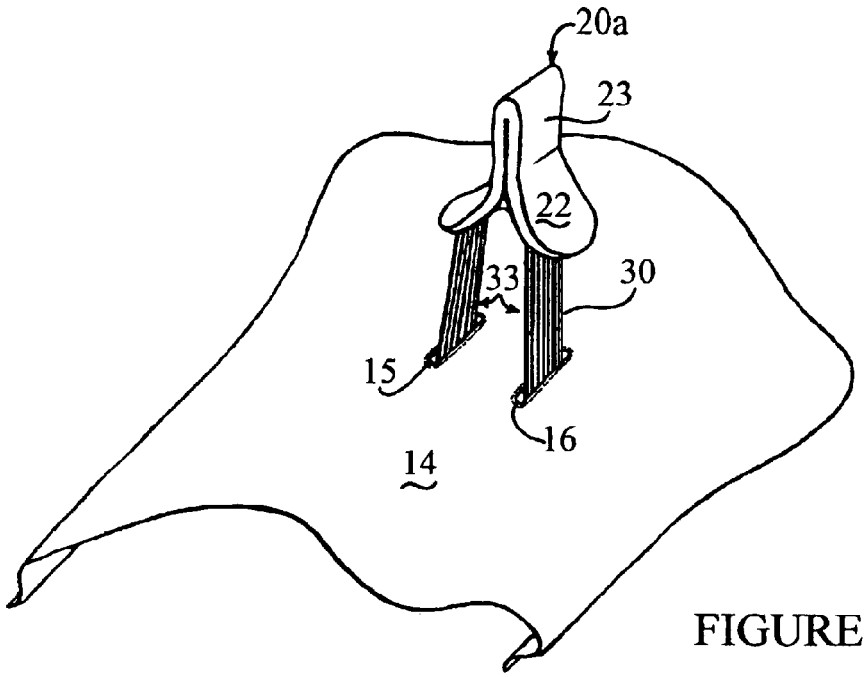
FIG. 4 illustrates the shoe lace fastener of FIG. 1 in an extended position defining an opening for receiving loops and tails of shoe laces.
Figure 5:
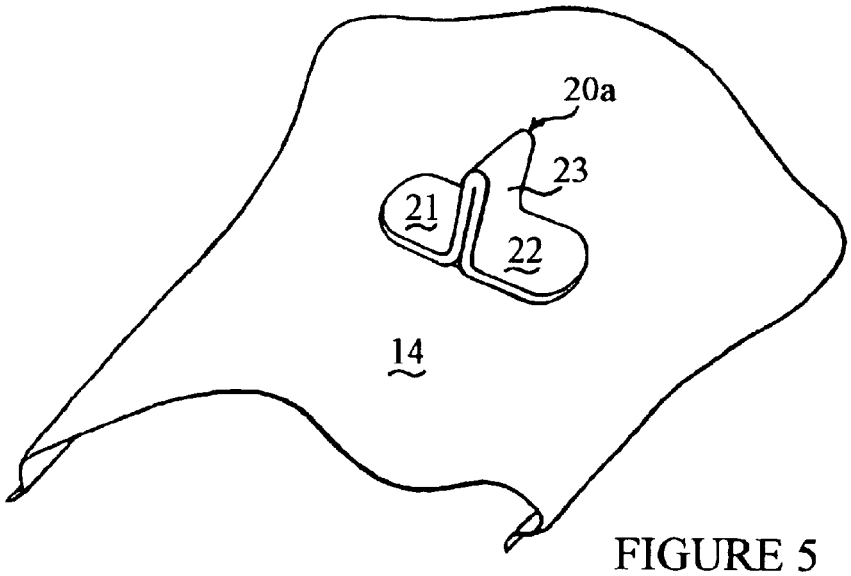
FIG. 5 shows the shoe lace fastener of FIG. 1 in a relaxed position on the surface of the shoe tongue.

It will be appreciated that by forming the tab 20 of somewhat rigid material and utilizing a belly piece 60 of some width, lateral separation, shown as distance A in FIG. 3A, may be maintained between the upwardly extended sections of the tension band, approximating the lateral spacing between the openings 15, 16 in the top layer 14 of the tongue 13. This spacing is illustrated in FIG. 4 when pull tab 20*a* has been pulled upward away from the top layer 14 of the tongue. The tension band 30 is kept to a length so that when in a relaxed state the winged pull tab 20*a* rests adjacent to the top layer 14 of the tongue, yet when pulled into an extended position, a clearance of about one to three inches above the top surface may be attained. In the preferred construction, left and right wings 21, 22 of pull tab 20*a* will bend slightly under tension and will partially fit beneath the facings of the shoe in rest position, as shown in FIG. 6B.

It will also be understood that while the invention has been disclosed with a separate foundation plate which may be necessary to provide lateral strength in shoe tongues of existing design, it is also possible that in shoe tongues utilizing a relatively stiff non-woven layer or other suitable materials providing some lateral stiffness to the tongue, the foundation plate might be dispensed with and the ends 31, 32 of tension band 30 simply pass into the tongue 13 through openings 15, 16 and be stitched, bonded or adhered to an interior surface of a layer of the tongue. Generally adhering the ends 31, 32 to a foundation plate 40 that is permitted to move slightly within the tongue 13 provides the best performance.

Figure 6A:
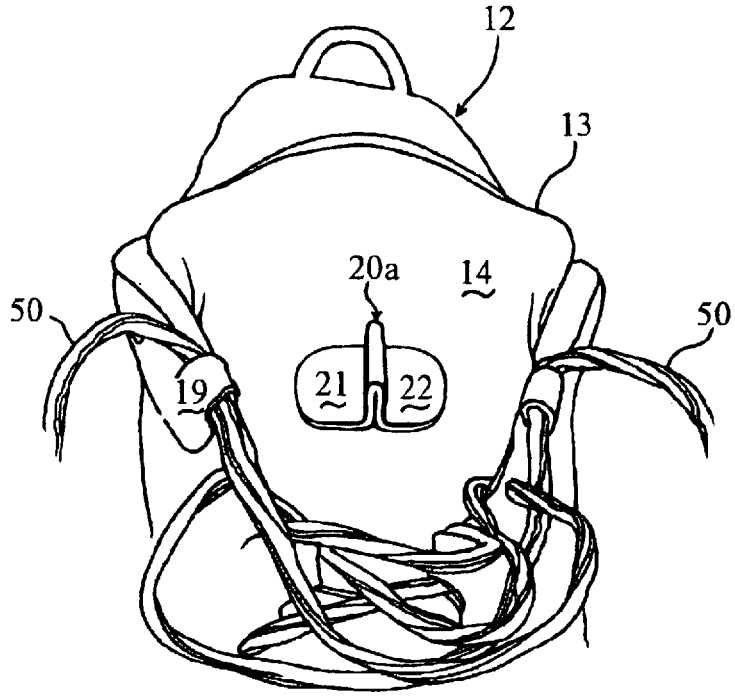
FIGS. 6A through 6F sequentially illustrate the tying of the shoe and securing of the loops and tails of the shoe laces in the shoe lace fastener of FIG. 1.
Figure 6B:
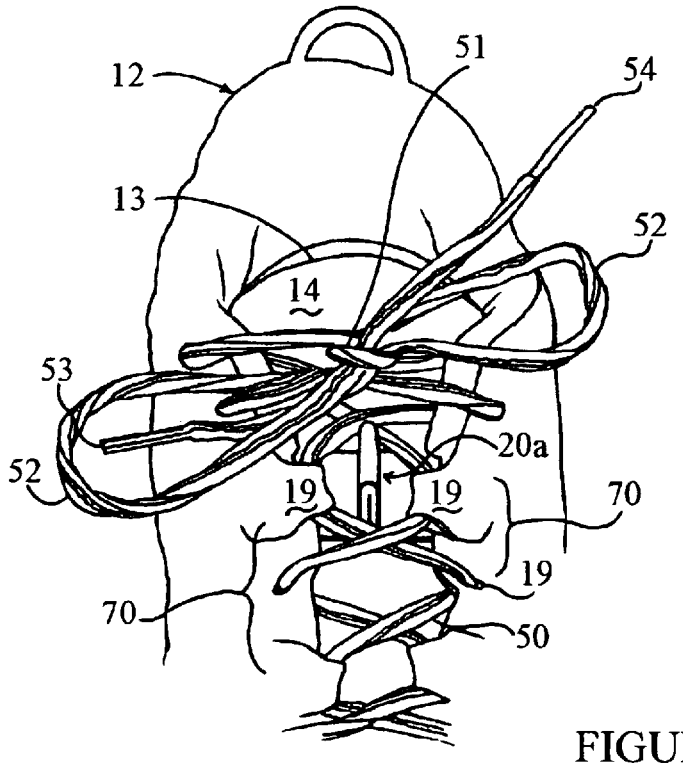

FIGS. 6A through 6E show the winged pull tab 20*a* of FIG. 1 in use on an athletic shoe 12. FIG. 6A depicts the tab 20*a* in its position on the top layer 14 of shoe tongue 13 in shoe 12 having shoe laces 50 threaded through eyelets 19. In FIG. 6B the shoe laces have been pulled tight through eyelets 19 which are mounted on facings 70 of shoe 12. The laces 50 have also been tied into knot 51 having loops 52 and first tail end 53 and second tail end 54. The tongue 13 is positioned beneath the laces yet the grasping element 23 (shown in FIG. 6D) of winged pull tab 20*a* protrudes for accessibility.

Figure 6C:
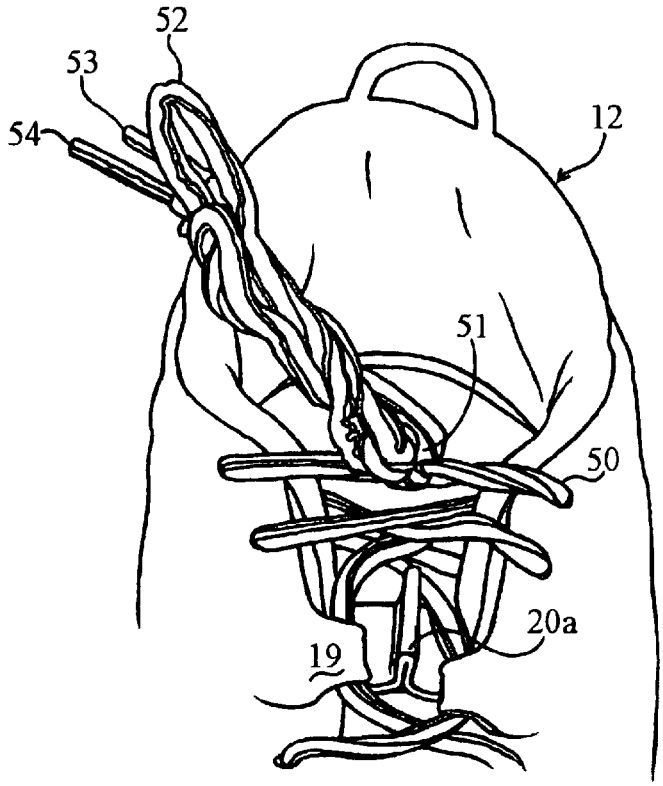
Figure 6D:
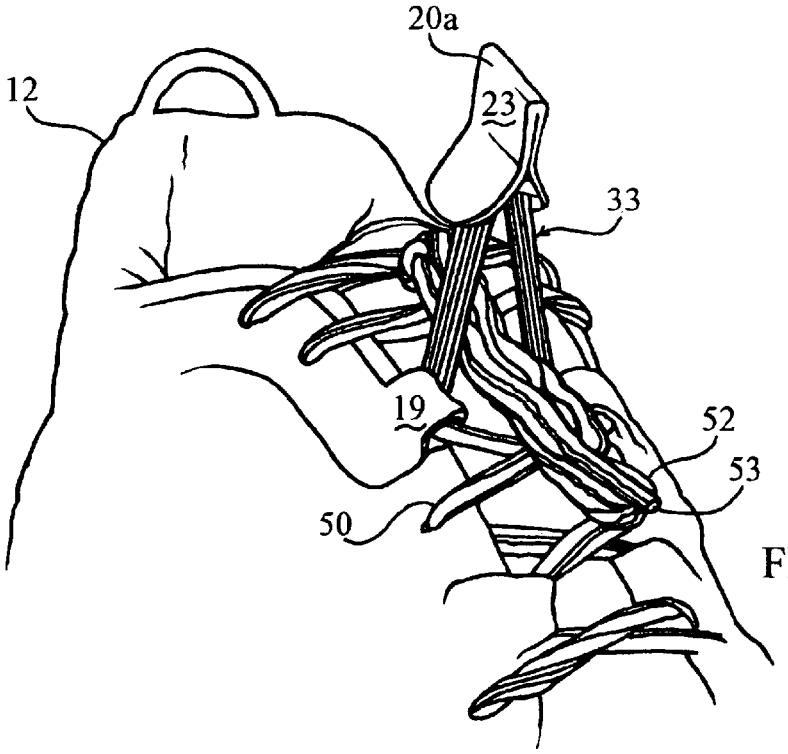

Once the shoe has been laced and tied as in FIG. 6B, FIG. 6C shows the loops 52 and tails 53, 54 being gathered together in a lengthwise direction from knot 51. Winged pull tab 20*a* is then raised away from the tongue 13 as shown in FIG. 6D and the intermediate stretching section 33 of tension band 30 permits the creation of clearance space through which loops 52 and tails 53, 54 are inserted.

Figure 6E:
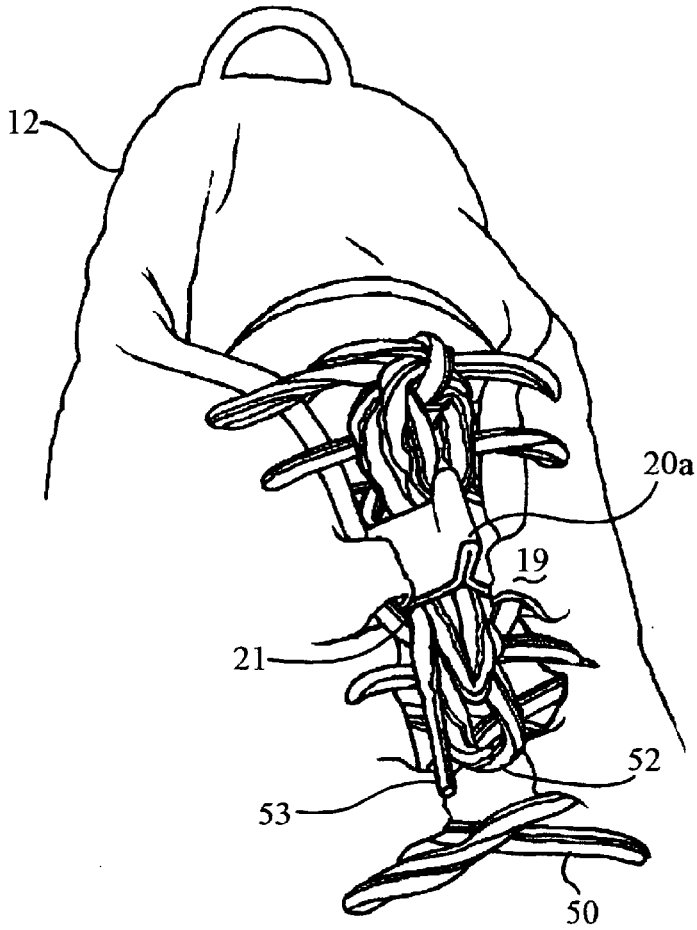
Figure 6F:
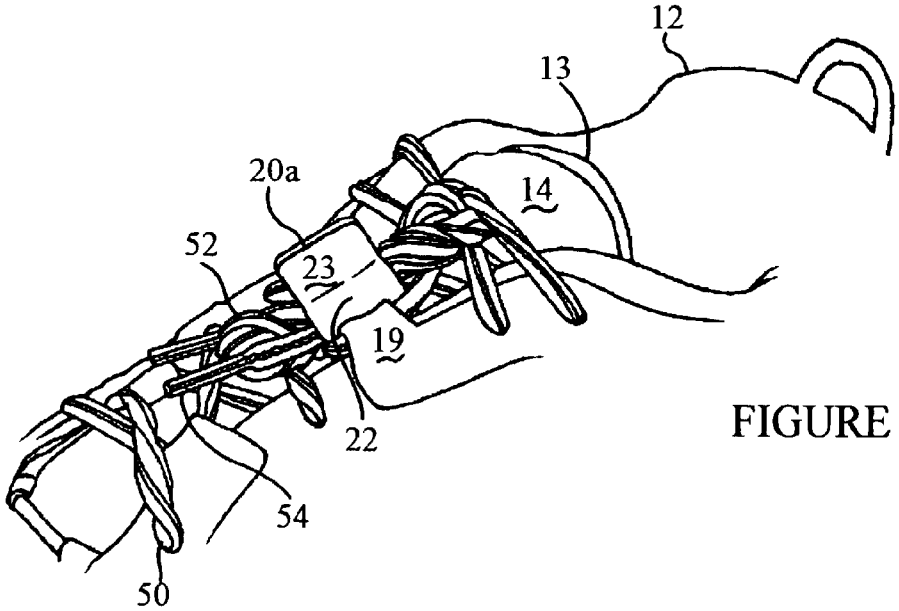

FIGS. 6E and 6F depict a shoe lace fastener after tension on pull tab 20*a* has been relaxed and tension band 30 has again returned pull tab 20*a* to proximity to the tongue 13 of shoe 12. In this fashion, the tension band 30 and pull tab 20*a* hold the loops 52 and tails 53, 54 proximate to the shoe tongue 13 and facings 70 (shown in FIG. 6B). Advantageously, left wing 21 and right wing 22 of winged pull tab 20*a* may be received beneath protruding eyelets 19 on the facings 70.

FIGS. 7A and 7B illustrate a slightly altered winged pull tab 20*b* with more rounded edges on wings 21, 22 and grasping element 23. In this alternative embodiment, the winged pull tab 20*b* fits within a housing 17 mounted to the top layer 14 of the shoe tongue. The housing may display a logo, brand or design elements, and is preferably made of a pliable material to prevent discomfort to the wearer when lacing pressure forces the tongue and housing 17 against the top of the wearer's foot.

FIG. 8 displays an alternative tab 20*c* with a grasping element 23 designed to lay relatively flat above laces 50, substantially parallel to the tongue 13 and with a central space adapted for display of a logo, brand or design information. By conforming the grasping element 23 above the laces in this fashion, the alternative tab 20*c* may both be suitable for use on shoes adapted to kick and guide balls such as soccer shoes, and also serve to protect the laces.

FIGS. 9 and 10 depict an alternative with unitarily molded tab 20*d* having a back piece 69 defining an opening for tension band 30, in the place of a belly plate. Because the illustrated design has left end 31 of tension band 30 attached at left side 71 of the shoe tongue, as by the stitching 68, and the right end 32 is attached at right side 72 of the shoe tongue 13 or top layer of shoe tongue 14, it is not as critical to have a significant lateral distance over which the tension band 30 is held adjacent to tab 20*d*. The use of molded tab 20*d* creates a triangular opening with a relatively broad base instead of the rectangular opening created by tabs 20*a*, 20*b* illustrated in FIGS. 1 through 7. While ends 31, 32 of tension band 30 are shown attached close to the edges of the shoe tongue, so long as they are attached on portions of the tongue that lie under the facings of the shoe upper, or are attached to a tongue with sufficient internal lateral support, the shoe tongue may avoid undue deformation from the tension of the band when the tab is extended to create an opening to receive loops and tails. Molded tabs 20*d* may be advantageously formed in colors to complement particular shoe styles, or be formed with designs such as happy faces, roses, footballs or other sports equipment items, pet or doll figures, or other shapes appropriate to the shoe style, and intended wearer.

FIG. 11 depicts an alternative tab 20*e* formed by simple looping of nylon or other fabric or plastic about tension band 30 thereby defining opening 25 through which tension band 30 is passed. Tab 20*e* may be formed with a variety of shapes or decoration, and the fabric can be selected in a color or pattern complimentary to the shoe.

Figure 12A:
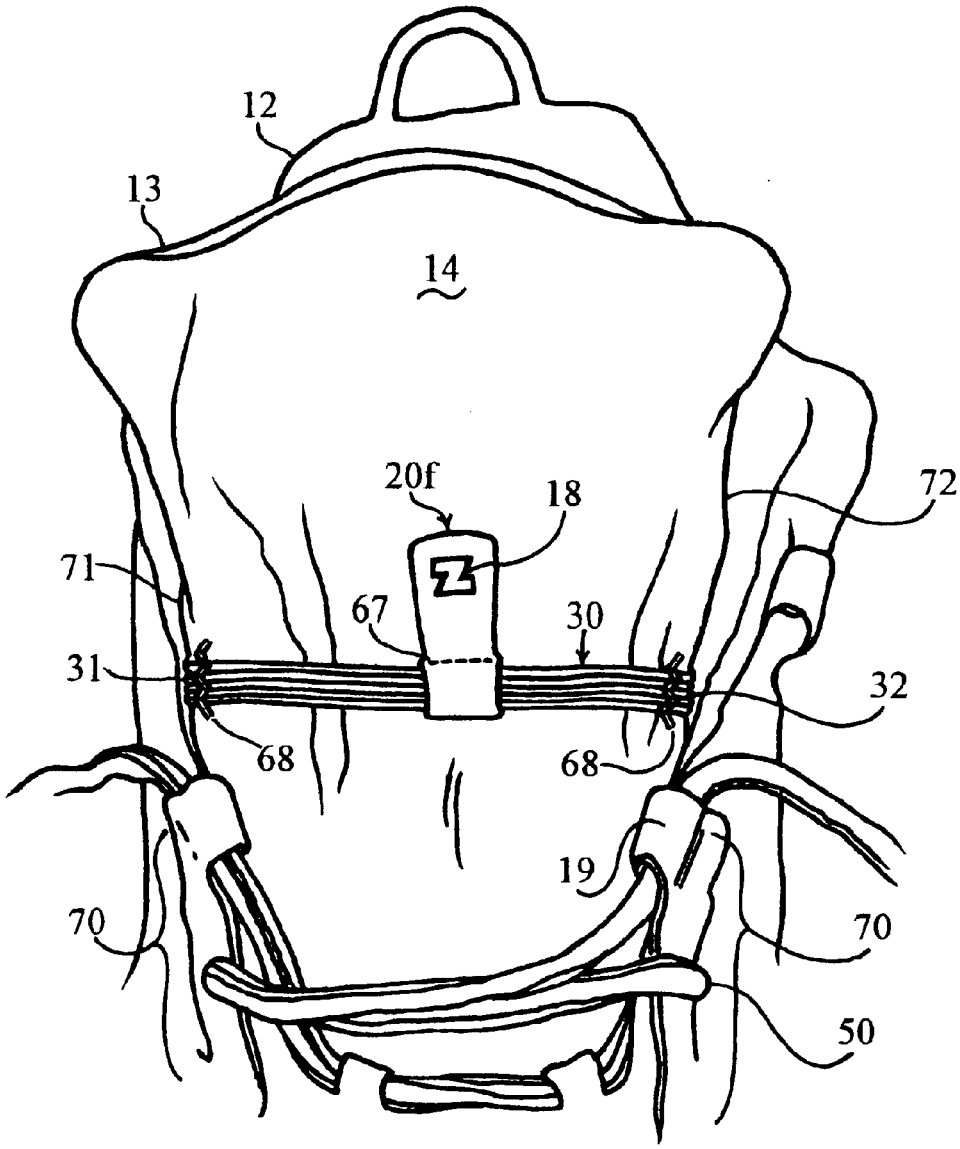
FIGS. 12A through 12E demonstrate the steps of tying a shoe and securing the loops and tails with the resulting knot in an alternative embodiment of the shoe lace fastener of the present invention.

FIGS. 12A through 12E demonstrate again the utilization of a shoe lace fastener according to the present invention, with a pull tab 20*f* bearing logo or design information 18 and being formed as a single piece of material encompassing tension band 30 and being bonded or sewn 67*a* as indicated. Different elastic bands are suitable for use as tension bonds on different shoes, from broad flat bands, to thinner flat bands, to oval or round bands, of various diameters. Usually larger bands are best suited for adult shoes and smaller bands for infant shoes. Commercially available apparel elastics are generally suitable. In FIG. 12A, tension band 30 extends from left end 31 to right end 32, each end being sewn 68 to top surface 14 of shoe tongue 13. Because the tension band 30 extends from left side 71 to right side 72 of the tongue, the sewn ends will rest under the facings 70 of the shoe upper.

Figure 12B:
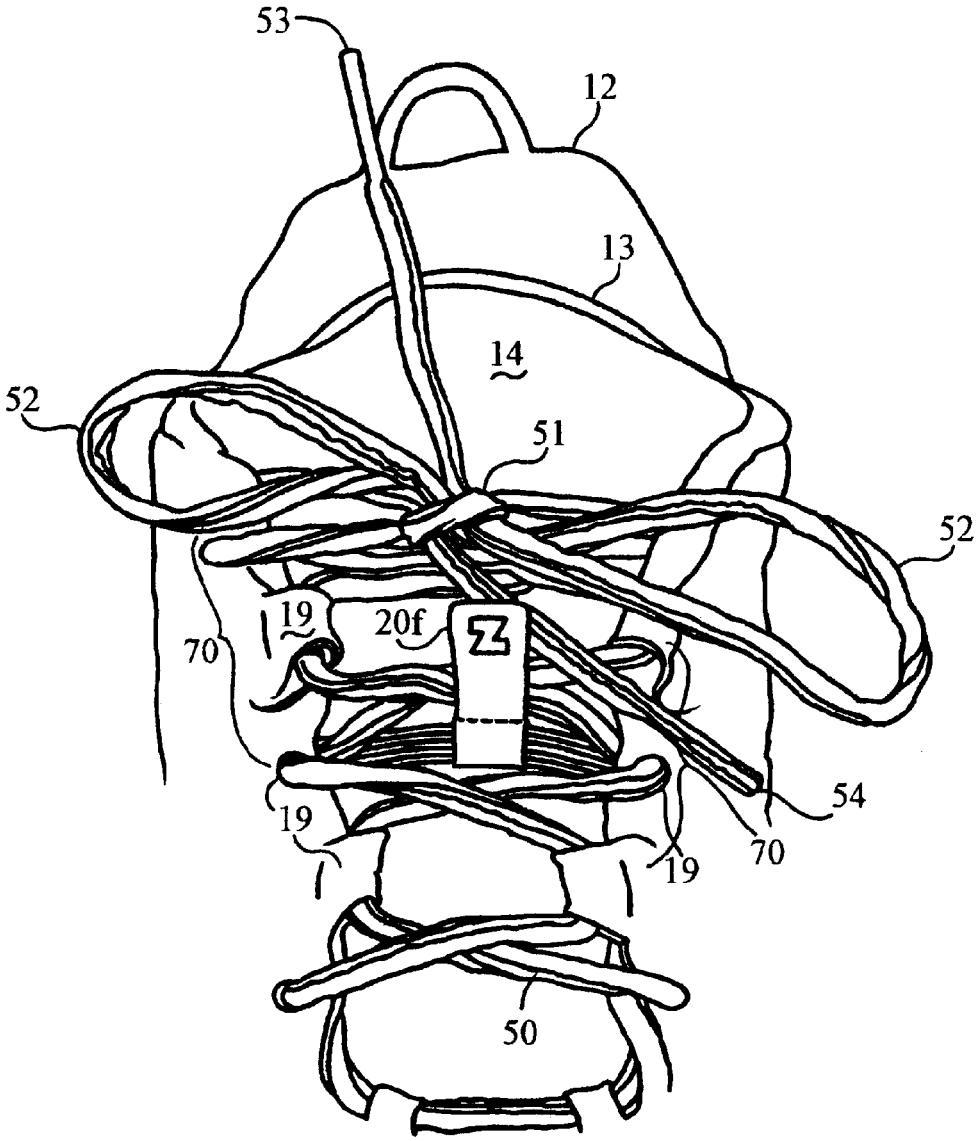
Figure 12C:
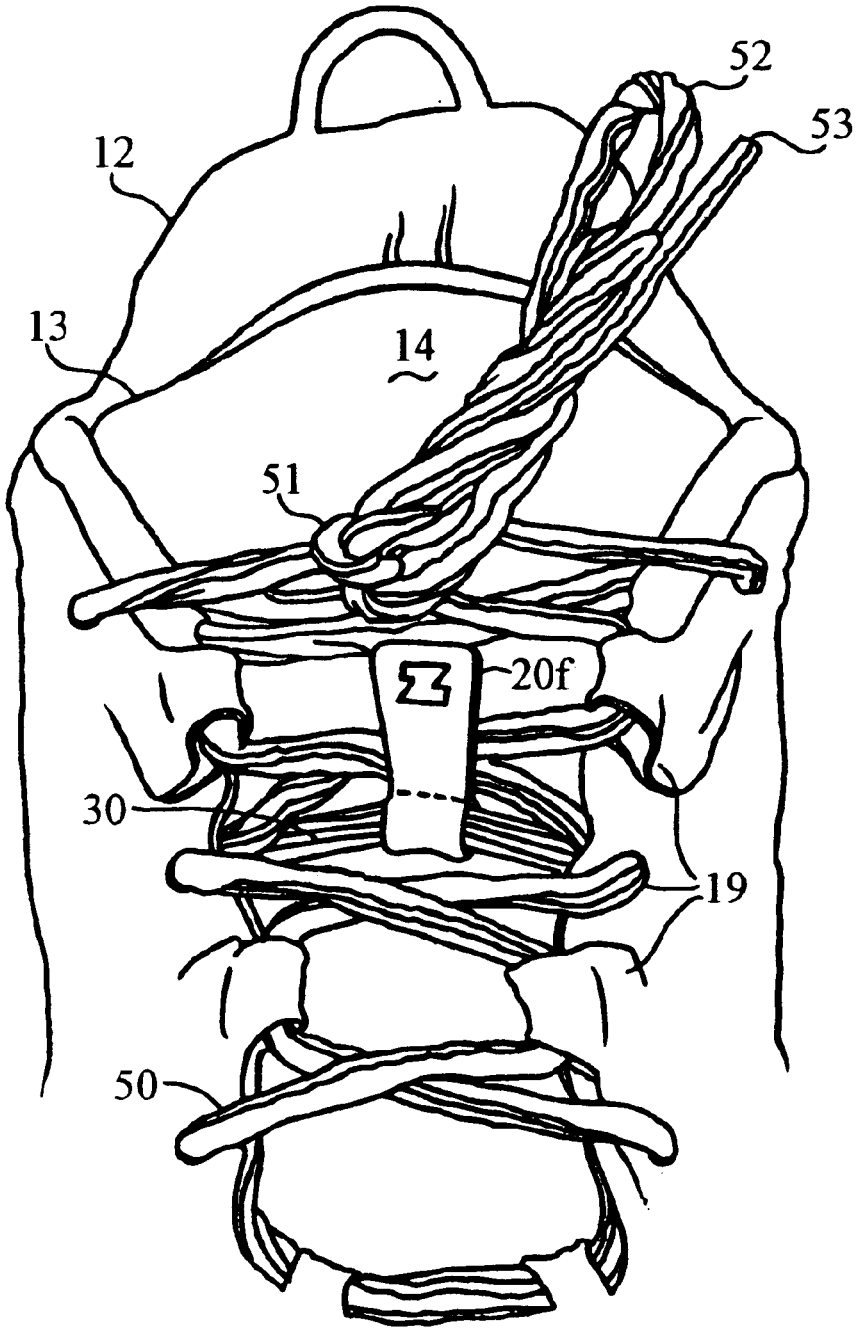
Figure 12D:
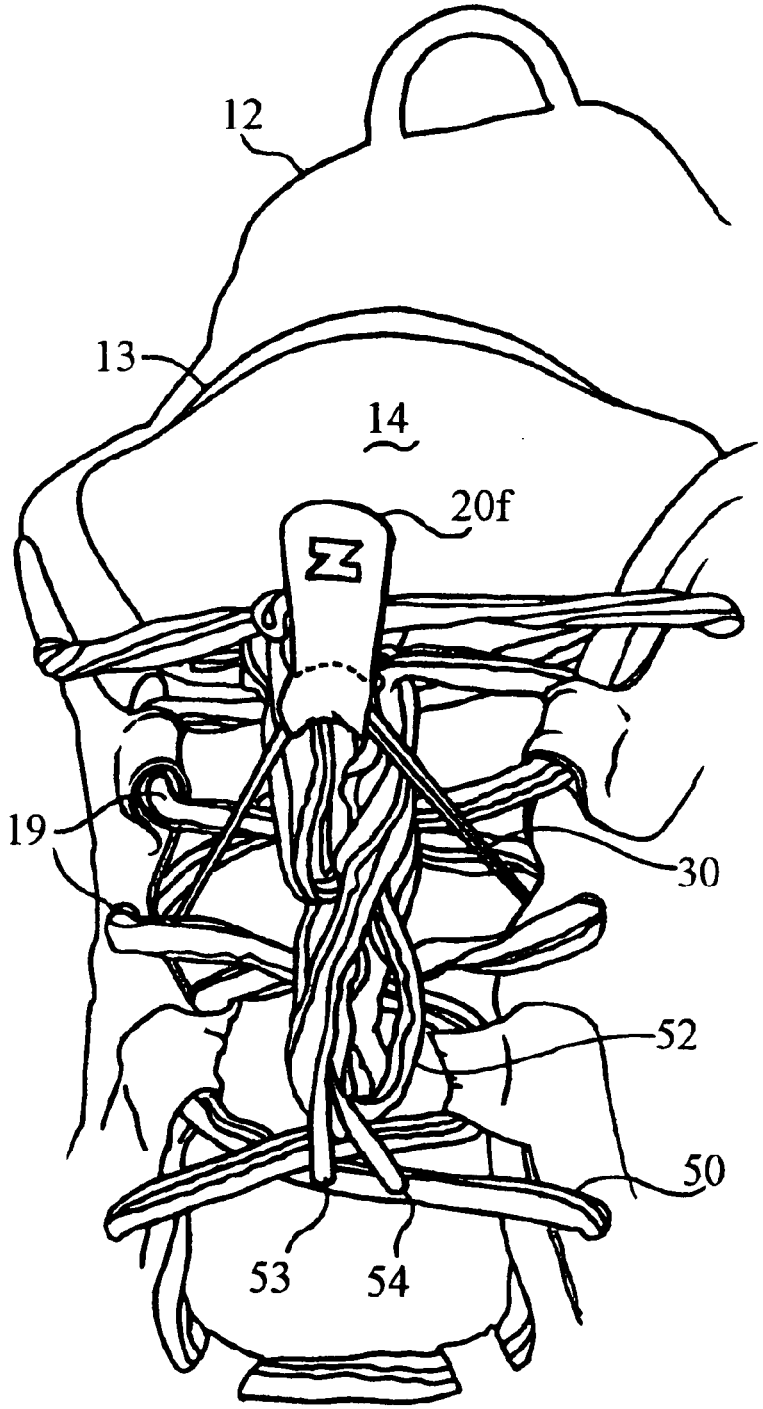
Figure 12E:
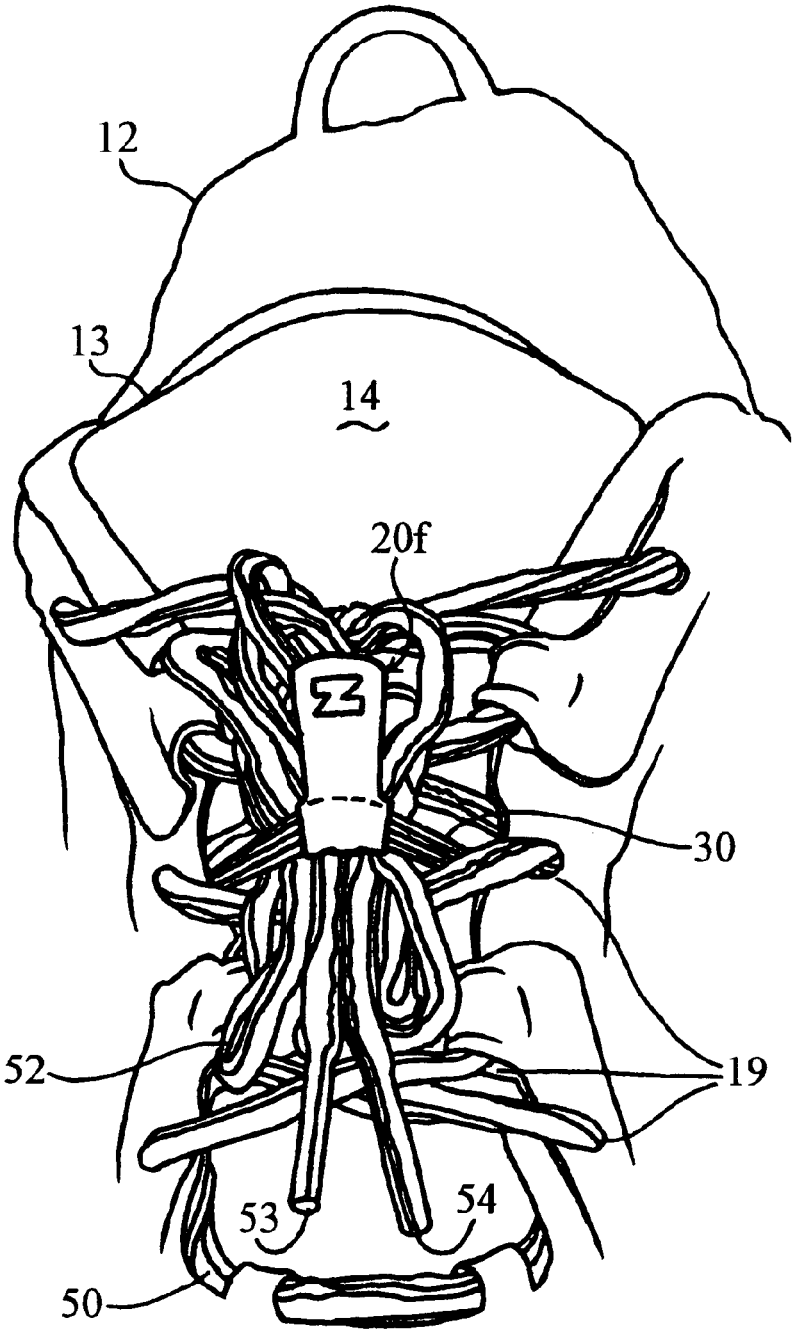

In FIG. 12A the shoe is only partly laced with laces 50 passing through eyelets 19. In FIG. 12B the shoe 12 has been completely laced and the laces 50 tied in knot 51 thereby defining loops 52 and first tail end 53 and second tail end 54. It will be seen that the ends 31, 32 of tension band 30 are concealed beneath the eyelets 19 and facing 70. In FIG. 12C the loops 52 and tails 53, 54 have been gathered and extended away from knot 51. In FIG. 12D pull tab 20*f* has been raised by applying force to stretch tension band 30 to create a relatively broad based triangular opening through which loops 52 and tails 53, 54 have been passed. The tension is then removed so the force on pull tab 20*f* is relaxed in FIG. 12E and the tension band 30 holds the loops 52 and tails 53, 54 proximate the shoe tongue 13.

Although the present invention has been described with reference to certain preferred embodiments disclosed in detail, it is to be understood that this is for the purpose of illustrating the invention, and should not be construed as necessarily limiting the scope of the invention since it is apparent that many changes may be made to the disclosed components and procedures by those skilled in the art to suit particular applications.

What is claimed is:

1. A shoe of the type having a sole and an upper, the upper having a tongue attached toward the toe portion of the shoe and extending rearward toward the heel portion of the shoe beneath left and right facings each containing eyelets through which shoe laces are laced, in combination with a shoe lace fastener comprising a tab secured to a tension band, said tension band having a left end fixedly attached to a left portion of the tongue and a right end fixedly attached to the right portion of the tongue such that in a relaxed state the tension band rests adjacent to the tongue and in an extended state an opening is created between the tension band and the tongue through which loops and tails from knotted laces may be inserted.

2. The shoe and shoe lace fastener of claim 1 wherein the tab is integrally molded from thermoplastic resin with an opening to receive the tension band.

3. The shoe and shoe lace fastener of claim 1 wherein the tab further comprises a decorative portion.

4. The shoe and shoe lace fastener of claim 1 wherein the tab is formed of a single strip of material joined to itself around the tension band.

5. The shoe and shoe lace fastener of claim 1 wherein the tab has a bottom and a belly piece attached thereto define an opening to receive the tension band.

6. The shoe and shoe lace fastener of claim 1 wherein the left end of the tension band is attached to an outer surface of the tongue and the right end of the tension band is attached to an outer surface of the tongue.

7. The shoe and shoe lace fastener of claim 1 wherein the tab comprises an upstanding grasping portion and a first wing extending laterally to the right and the second wing extending laterally to the left of the grasping portion.

8. The shoe and shoe lace fastener of claim 1 wherein the tab has a grasping portion above the shoe laces and extending substantially parallel to the tongue.

9. A shoe of the type having a sole and an upper, the upper having a tongue attached toward the toe portion of the shoe and extending rearward toward the heel portion of the shoe beneath left and right facings each containing eyelets through which shoe laces are laced, in combination with a shoe lace fastener comprising a tab secured to a tension band having a left end attached to a left portion of the tongue and a right end attached to a right portion of the tongue such that in a relaxed state the tension band rests adjacent to the tongue and in an extended state an opening is created between the tension band and the tongue through which loops and tails from knotted laces may be inserted, and wherein the tongue has an upper layer and a foundation plate beneath the upper layer, said foundation plate extending laterally within the tongue from left to right and the left end of the tension band is attached to a left portion of the foundation plate and the right end of the tension band is attached to a right portion of the foundation plate.

10. A shoe of the type having a sole and an upper, the upper having a tongue attached toward the toe portion of the shoe and extending rearward toward the heel portion of the shoe beneath left and right facings each containing eyelets through which shoe laces are laced, in combination with a shoe lace fastener comprising a tab mounted on a tension band, said tension band having a left end passing downward into the tongue and through a slot in a foundation plate and said left end being secured to the foundation plate, said tension band further having a right end passing downward into the tongue and through a slot in the foundation plate and said right end being secured to the foundation plate.

11. The shoe and shoe lace fastener of claim 10 wherein the tongue has a top layer over the foundation plate and said tension band left end and right end pass through the top layer.

12. The shoe and shoe lace fastener of claim 11 wherein the foundation plate is moveable relative to the top layer of the tongue.

13. The shoe and shoe lace fastener of claim 10 wherein the top layer of the tongue has a first slot for receiving the left end of the tension band and a second slot for receiving the right end of the tension band.

14. The shoe and shoe lace fastener of claim 10 wherein the foundation plate extends laterally from a right portion beneath the right facing to a left portion beneath the left facing of the shoe.

15. The shoe and shoe lace fastener of claim 10 wherein the left end of the tension band is secured to the foundation plate beneath the left facing and the right end of the tension band is secured to the foundation plate beneath the right facing of the shoe.

16. The shoe and shoe lace fastener of claim 10 wherein the tab has a grasping portion that lies substantially parallel to the tongue above the shoe laces.

17. The shoe and shoe lace fastener of claim 10 further comprising knotted shoe laces having loops and tails, wherein said loops and tails are secured against the tongue by the tension band.

18. The shoe and shoe lace fastener of claim 10 wherein a graspable tab is mounted on the tension band.

19. The shoe and shoe lace fastener of claim 18 wherein the tab has a central grasping portion and a left wing and a right wing such that when the tab is released and the tension band is retracted, the left wing fits beneath a portion of the left facing and the right wing fits beneath a portion of the right facing of the shoe.

20. The shoe and shoe lace fastener of claim 17 wherein the knotted shoe laces cause the right facing of the shoe to exert pressure on the tension band in the right portion of the tongue and cause the left facing to exert pressure on the tension band in the left portion of the tongue such that the tongue does not distort substantially when the tab is pulled to elongate the tension band.

* * * * *